US010126098B2

(12) United States Patent
Kruse

(10) Patent No.: US 10,126,098 B2
(45) Date of Patent: Nov. 13, 2018

(54) REAR SIGHT FOR FIREARM

(71) Applicant: I.P. Holding Group I, LLC, St. Louis, MO (US)

(72) Inventor: Russell E. Kruse, St. Charles, MO (US)

(73) Assignee: I.P. HOLDING GROUP I, L.L.C., St. Louis, MO (US)

( * ) Notice: Subject to any disclaimer, the term of this patent is extended or adjusted under 35 U.S.C. 154(b) by 34 days.

(21) Appl. No.: 15/134,741

(22) Filed: Apr. 21, 2016

(65) Prior Publication Data

US 2016/0231082 A1 Aug. 11, 2016

Related U.S. Application Data

(62) Division of application No. 13/797,219, filed on Mar. 12, 2013.

(51) Int. Cl.
*F41G 1/16* (2006.01)
*F41G 1/26* (2006.01)
*F41G 1/033* (2006.01)

(52) U.S. Cl.
CPC ..... *F41G 1/16* (2013.01); *F41G 1/033* (2013.01); *F41G 1/26* (2013.01)

(58) Field of Classification Search
CPC ... F41G 1/00; F41G 1/033; F41G 1/06; F41G 1/16; F41G 1/26; F41G 1/28
USPC ..... 42/135–138
See application file for complete search history.

(56) References Cited

U.S. PATENT DOCUMENTS

| | | | | |
|---|---|---|---|---|
| 691,242 A | | 1/1902 | Choles | |
| 882,182 A | | 3/1908 | Thompson | |
| 1,171,310 A | | 2/1916 | Bisbee | |
| 1,268,537 A | | 6/1918 | Bader | |
| 1,307,441 A | | 6/1919 | Frensdorf | |
| 1,316,945 A | | 9/1919 | Elliott | |
| 1,338,382 A | | 4/1920 | Lewis | |
| 1,755,635 A | | 4/1930 | Dindinger | |
| 1,929,418 A | | 10/1933 | Garand | |
| 2,127,565 A | | 8/1938 | King et al. | |
| 2,334,300 A | | 11/1943 | Williams | |
| 2,336,108 A | * | 12/1943 | Lowe | F41G 1/18 42/137 |
| 2,343,802 A | | 3/1944 | Rodney | |
| 2,374,722 A | | 5/1945 | Bailey | |
| 2,441,968 A | | 5/1948 | Henry | |
| 2,593,870 A | | 4/1952 | Ganzhorn | |

(Continued)

*Primary Examiner* — Stephen Johnson
*Assistant Examiner* — Benjamin S Gomberg
(74) *Attorney, Agent, or Firm* — Thompson Coburn LLP

(57) ABSTRACT

A rear sight comprises a base member and a top member. The base member comprises a fitting portion and a base member bearing surface. The fitting portion of the base member is attachable to a firearm. The top member comprises a rear sight alignment portion and a top member bearing surface. The top member bearing surface is slidably engageable with the base member bearing surface for pivotable movement of the top member relative to the base member between lowered and raised positions. Movement of the top member away from the lowered position and toward the raised position increases the distance between the rear sight alignment portion and a barrel axis of the firearm to thereby adjust the elevation of the rear sight alignment portion of the rear sight.

5 Claims, 8 Drawing Sheets

(56) References Cited

U.S. PATENT DOCUMENTS

| | | | | | |
|---|---|---|---|---|---|
| 2,682,707 | A * | 7/1954 | Dahlberg | F41G 1/08 | 42/137 |
| 2,706,335 | A | 4/1955 | Munsey | | |
| 2,788,600 | A * | 4/1957 | Pokorny | F41G 1/033 | 42/112 |
| 2,806,288 | A | 9/1957 | Sarvis | | |
| 2,871,566 | A * | 2/1959 | Everitt | F41G 1/00 | 42/137 |
| 3,100,936 | A | 8/1963 | Angelica | | |
| 3,199,202 | A | 8/1965 | Williams | | |
| 3,495,339 | A | 2/1970 | Eliason | | |
| 3,499,224 | A | 3/1970 | Squier | | |
| 3,662,469 | A | 5/1972 | Charron | | |
| 3,748,744 | A | 7/1973 | McClenahan | | |
| 3,984,916 | A | 10/1976 | Newcomb et al. | | |
| 4,127,943 | A | 12/1978 | Tiritilli | | |
| 4,249,332 | A | 2/1981 | Ng | | |
| 4,317,304 | A | 3/1982 | Bass | | |
| 4,477,979 | A * | 10/1984 | Oren | F41G 1/28 | 42/137 |
| 4,525,932 | A * | 7/1985 | Williams | F41G 1/16 | 42/148 |
| 4,628,611 | A | 12/1986 | Ruffino | | |
| 4,837,937 | A | 6/1989 | Hasselbusch | | |
| 5,063,677 | A | 11/1991 | Millett | | |
| 5,208,407 | A | 5/1993 | Stover | | |
| 5,210,953 | A | 5/1993 | Small | | |
| D382,038 | S | 8/1997 | Nigh | | |
| 5,822,872 | A | 10/1998 | Waki | | |
| 5,887,352 | A | 3/1999 | Kim | | |
| 6,035,539 | A | 3/2000 | Hollenbach et al. | | |
| 6,058,616 | A | 5/2000 | Bubits | | |
| D447,206 | S | 8/2001 | Ling, Jr. | | |
| 6,360,471 | B1 | 3/2002 | Stein | | |
| 6,711,846 | B1 | 3/2004 | Nasef | | |
| D519,184 | S | 4/2006 | Malley | | |
| 7,188,442 | B2 | 3/2007 | Fernandez | | |
| 7,451,566 | B1 | 11/2008 | Price | | |
| 7,526,890 | B1 | 5/2009 | Keng et al. | | |
| 7,610,712 | B2 | 11/2009 | Ertl | | |
| 7,832,138 | B1 | 11/2010 | Price | | |
| 7,946,075 | B2 | 5/2011 | Nasef | | |
| 2014/0259856 | A1 * | 9/2014 | Kruse | F41G 1/16 | 42/136 |

* cited by examiner

REAR SIGHT FOR FIREARM

CROSS-REFERENCE TO RELATED APPLICATIONS

This application is a divisional application of Ser. No. 13/797,219, filed on Mar. 12, 2013.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to sights for use in firearms. More specifically, the present invention pertains to rear sights for adjusting elevation and/or drift.

SUMMARY OF THE INVENTION

One aspect of the invention is a rear sight for use in a firearm. The firearm includes a barrel having a longitudinal barrel axis, a front sight having a front sight alignment portion, and a rear sight receiving portion. The rear sight receiving portion has a rear sight receiving slot rearwardly spaced from the front sight. The rear sight comprises a base member and a top member. The base member comprises a fitting portion and at least one base member bearing surface. The fitting portion of the base member is shaped and configured to be inserted into and retained in the sight receiving slot of the firearm. The top member comprises a rear sight alignment portion and at least one top member bearing surface. The rear sight alignment portion is adapted to be aligned with the front sight alignment portion of the firearm. The at least one top member bearing surface is slidably engageable with the at least one base member bearing surface for pivotable movement of the top member relative to the base member between a lowered position and a raised position. The base member and the top member being configured such that pivoting movement of the top member relative to the base member away from the lowered position and toward the raised position increases the distance between the rear sight alignment portion and the barrel axis of the firearm to thereby adjust the elevation of the rear sight alignment portion of the rear sight when the rear sight is attached to the firearm via the rear sight receiving slot. The base member is of a unitary, one-piece construction. The top member is of a unitary, one-piece construction.

Another aspect of the invention is a rear sight for use in a firearm. The firearm including a barrel having a longitudinal barrel axis, a front sight having a front sight alignment portion, and a rear sight receiving portion. The rear sight receiving portion is rearwardly spaced from the front sight. The rear sight comprises a base member and a top member. The base member comprises a fitting portion and at least one base member bearing surface. The fitting portion is operatively attachable to the rear sight receiving portion of the firearm. The top member comprises a rear sight alignment portion and at least one top member bearing surface. The rear sight alignment portion is adapted to be aligned with the front sight alignment portion of the firearm. The at least one top member bearing surface is slidably engageable with the at least one base member bearing surface for pivotable movement of the top member relative to the base member about a laterally extending elevation adjusting axis between a lowered position and a raised position. The base member and the top member are configured such that the elevation adjusting axis is generally perpendicular to a plane containing the barrel axis for all pivoting movement of the top member relative to the base member between the lowered and raised positions when the rear sight is operatively attached to the firearm via the rear sight receiving portion. The base member and the top member are configured such that the elevation adjusting axis is spaced from the base member for all pivoting movement of the top member relative to the base member between the lowered and raised positions. The base member and the top member are configured such that pivoting movement of the top member relative to the base member away from the lowered position and toward the raised position increases the distance between the rear sight alignment portion and the barrel axis of the firearm to thereby adjust the elevation of the rear sight alignment portion of the rear sight when the rear sight is operatively attached to the firearm via the rear sight receiving portion.

Another aspect of the present invention comprises a rear sight for use in a firearm. The firearm including a barrel having a longitudinal barrel axis, a front sight having a front sight alignment portion, and a slide portion. The slide portion has a rear sight receiving slot. The rear sight receiving slot extends generally along a laterally extending slot axis. The rear sight receiving slot is rearwardly spaced from the front sight. The rear sight comprises a base member and a top member. The base member comprises a fitting portion and at least one base member bearing surface. The fitting portion of the base member is shaped and configured to be inserted into and retained in the sight receiving slot of the slide portion of the firearm. The top member comprises a rear sight alignment portion and at least one top member bearing surface. The rear sight alignment portion is adapted to be aligned with the front sight alignment portion of the firearm. The at least one top member bearing surface is slidably engageable with the at least one base member bearing surface for pivotable movement of the top member relative to the base member about a laterally extending elevation adjusting axis between a lowered position and a raised position. The top member and the base member are adapted and configured such that the elevation adjusting axis is generally parallel to the slot axis when the rear sight is attached to the slide portion of the firearm via the rear sight receiving slot. The base member and the top member are configured such that the elevation adjusting axis is spaced from the base member. The base member and the top member are configured such that pivoting movement of the top member relative to the base member away from the lowered position and toward the raised position increases the distance between the rear sight alignment portion and the barrel axis of the firearm to thereby adjust the elevation of the rear sight alignment portion of the rear sight when the rear sight is attached to the slide portion of the firearm via the rear sight receiving slot.

Further features and advantages of the present invention, as well as the operation of the invention, are described in detail below with reference to the accompanying drawings.

Figure 1:
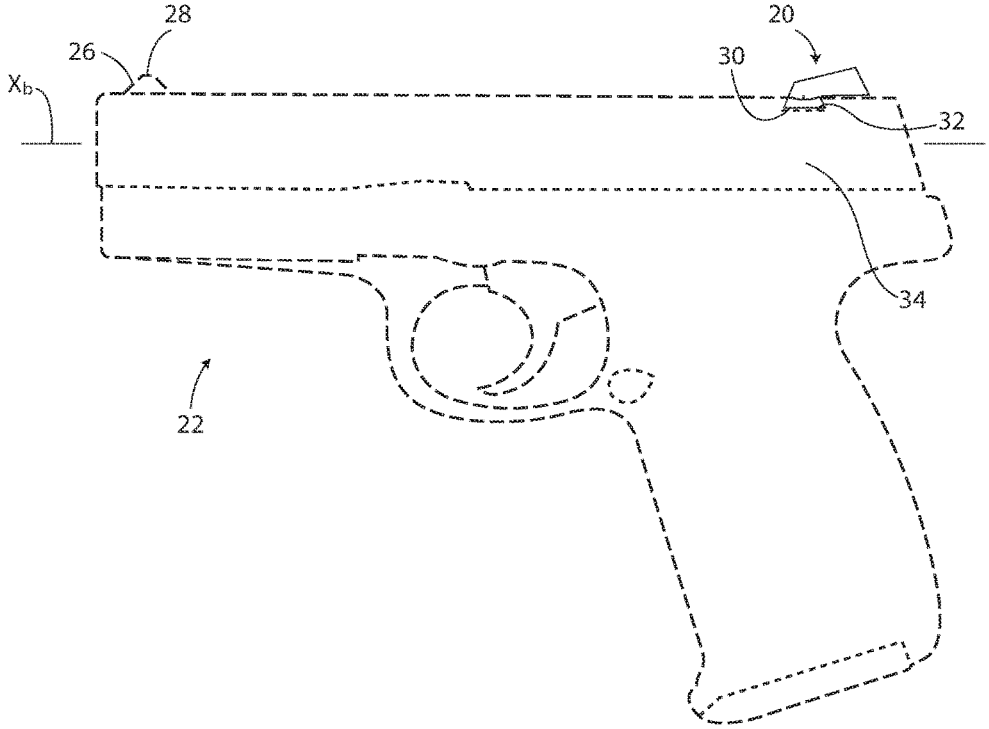
FIG. 1 is a side elevational view of an embodiment of a rear sight of the present invention, the rear sight being shown attached to a sight receiving slot in a slide of a firearm.
Figure 2:
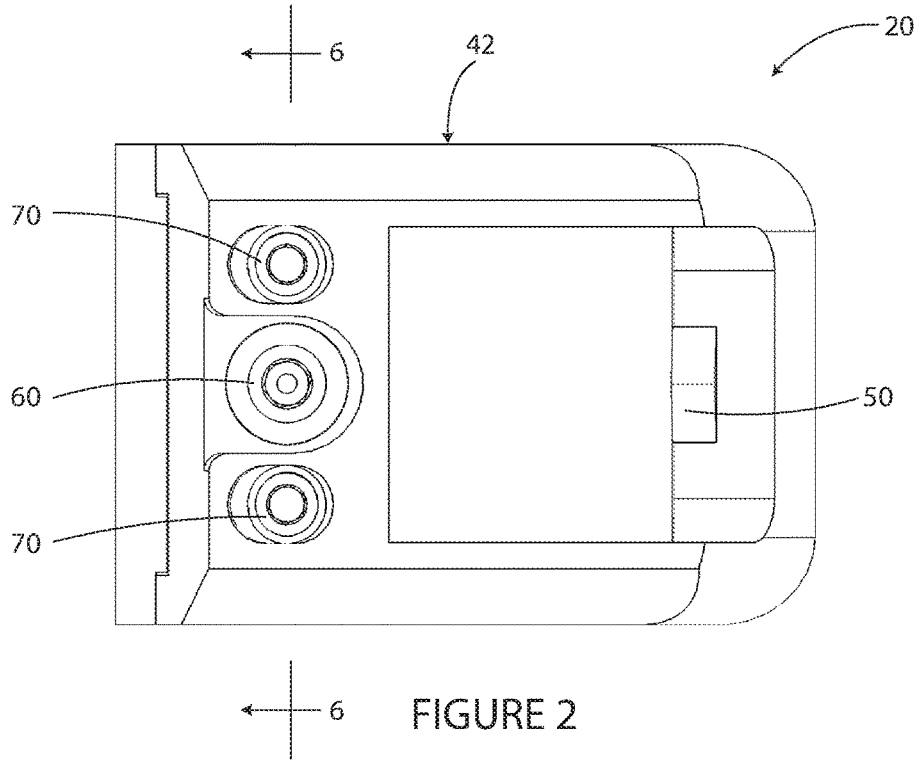
FIG. 2 is a top plan view of the rear sight of FIG. 1.
Figure 3:
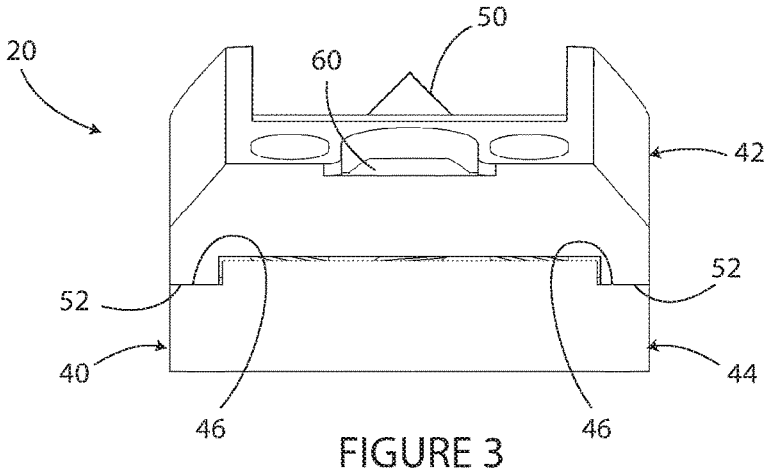
FIG. 3 is front elevational view of the rear sight of FIGS. 1 and 2.
Figure 4:
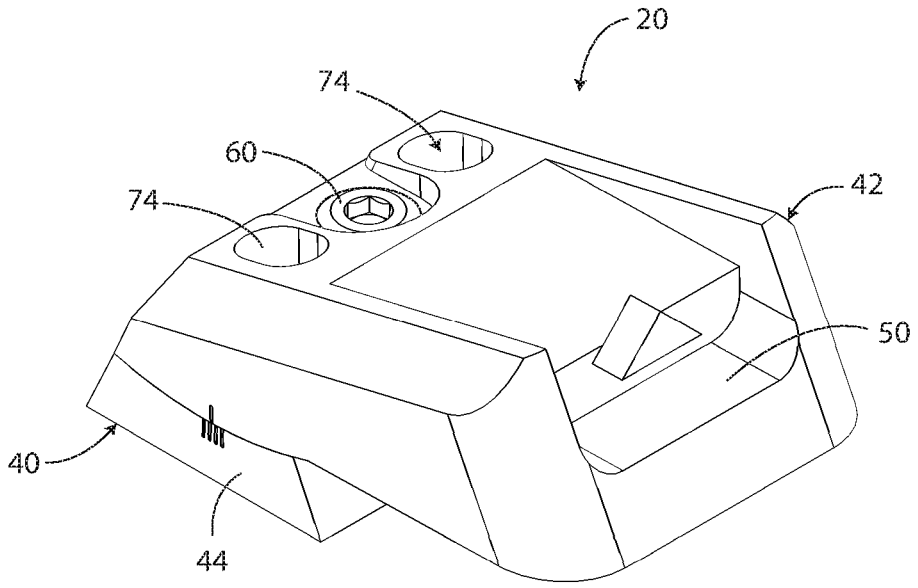
FIG. 4 is a perspective view of the rear sight of FIGS. 1-3.

Reference numerals in the written specification and in the drawing figures indicate corresponding items.

DETAILED DESCRIPTION

Figure 5:
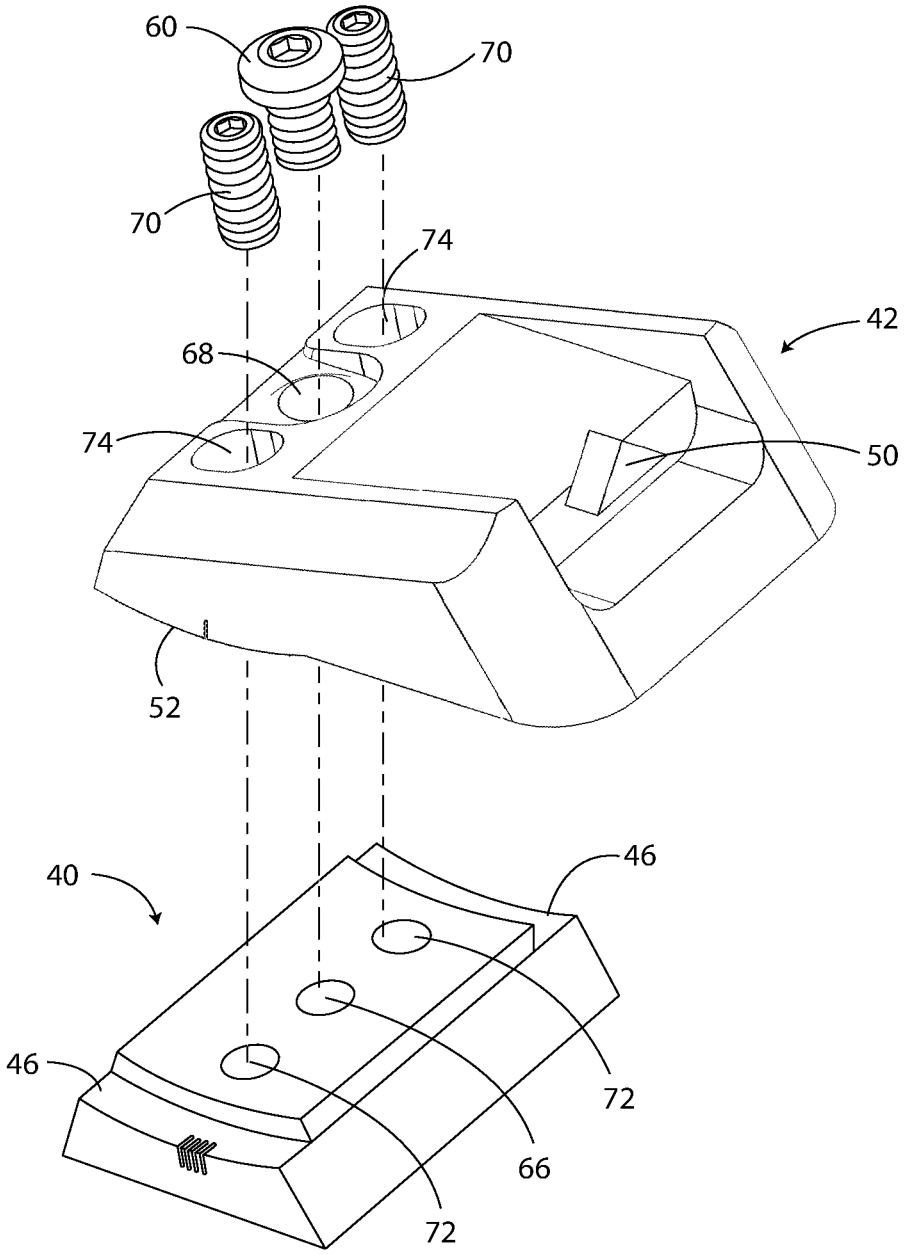
FIG. 5 is an exploded perspective view of the rear sight of FIGS. 1-4.
Figure 6:
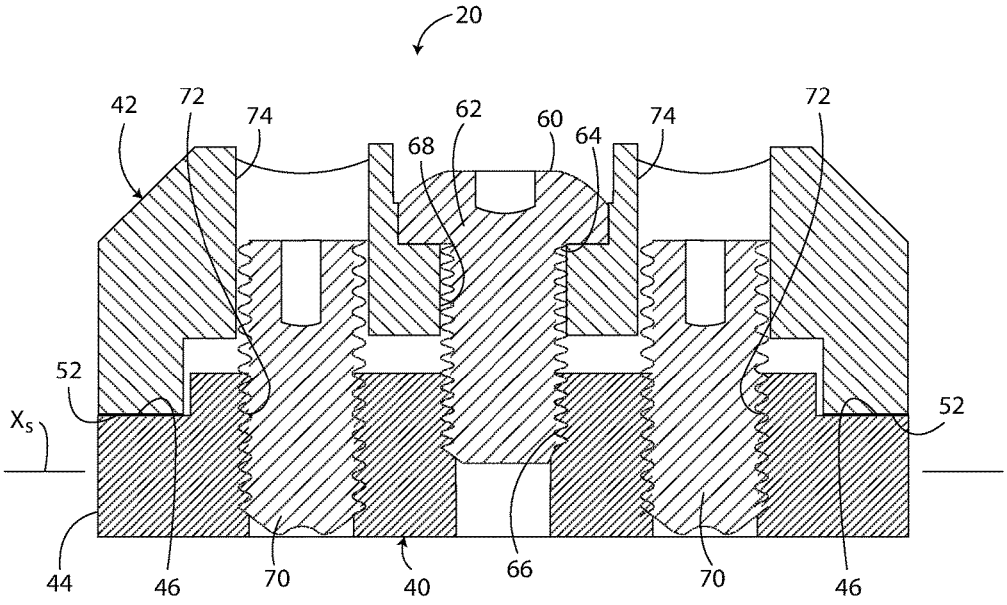
FIG. 6 is a cross-sectional view taken along the plane of line 6-6 of FIG. 2 and shows a base member, a top member a threaded fastener, and two set screws.

A rear sight of the present invention is generally indicated by reference numeral 20 in FIGS. 1-7. As shown in FIG. 1, the rear sight 20 is adapted to attach to a conventional firearm 22. The firearm 22 including a barrel having a longitudinal barrel axis $X_b$, a front sight 26 having a front sight alignment portion 28, and a rear sight receiving portion 30 rearwardly spaced from the front sight. The rear sight receiving portion 30 may comprise a rear sight receiving slot 32 in a slide portion 34 of the firearm 22. The rear sight receiving slot 32 extends generally along a laterally extending slot axis $X_s$ (FIG. 6). Although the firearm has been described as having a sight receiving slot in a slide portion, it is to be understood that a rear sight in accordance with the present invention may be used with firearms that do not have slides and that do not have sight receiving slots.

The rear sight comprises a base member 40 and a top member 42. Preferably, the base member 40 is of a unitary, one-piece construction and the top member is of a unitary, one-piece construction. In other words, to minimize parts, it is preferred that neither the base member 40 nor the top member 42 is formed of multiple parts. The base member 40 comprises a fitting portion 44 and at least one, and preferably two, base member bearing surfaces 46. The fitting portion 44 is operatively attachable to the rear sight receiving portion 30 of the firearm 22. In the embodiment shown in FIGS. 1-8, the fitting portion 44 is shaped and configured to be inserted into and retained in the sight receiving slot 32 of the slide portion 34 of the firearm 22. The sight receiving slot 32 is shaped for receiving a dovetail fitting. Thus, in the present embodiment, the fitting portion has a dovetail shape.

The top member 42 comprises a rear sight alignment portion 50 and comprises at least one, and preferably two, top member bearing surfaces 52. The rear sight alignment portion 50 is adapted to be aligned with the front sight alignment portion 28 of the firearm 22. Each top member bearing surface 52 is slidably engageable with a corresponding one of the base member bearing surfaces for pivotable movement of the top member 42 relative to the base member 40 about a laterally extending elevation adjusting axis $X_e$ between a lowered position (shown in solid lines in FIG. 7) and a raised position (shown in dashed lines in FIG. 7). The base member 40 and the top member 42 are configured such that the elevation adjusting axis $X_e$ is generally perpendicular to a plane containing the barrel axis $X_b$ for all pivoting movement of the top member relative to the base member between the lowered and raised positions when the rear sight 20 is operatively attached to the firearm 22 via the rear sight receiving portion 30. The base member 40 and the top member 42 are configured such that the elevation adjusting axis $X_e$ is spaced from the base member for all pivoting movement of the top member relative to the base member between the lowered and raised positions. The base member 40 and the top member 42 are configured such that pivoting movement of the top member relative to the base member away from the lowered position and toward the raised position increases the distance between the rear sight alignment portion 50 and the barrel axis $X_b$ of the firearm 22 to thereby adjust the elevation of the rear sight alignment portion 50 of the rear sight 20 when the rear sight is operatively attached to the firearm via the rear sight receiving portion 30.

Preferably, each top member bearing surface 52 is adapted to nest with the corresponding base member bearing surface 46. Preferably, each base member bearing surface 46 is concave and each top member bearing surface 52 is convex. In the present embodiment, each top member bearing surface 52 constitutes an arcuate bearing surface having a radius of curvature $r_c$ (FIG. 7) and each base member bearing surface 46 constitutes an arcuate bearing surface having a radius of curvature. In the present embodiment, the radius of curvature of each of the top member bearing surfaces 52 has substantially the same radius of curvature as the other. In the present embodiment, the radius of curvature of each of the base member bearing surface 46 has substantially the same radius of curvature as the other. In the present embodiment, the radius of curvature of each of the top member bearing surfaces 52 is substantially the same as the radius of curvature of each of the base member bearing surfaces 46. In the present embodiment, each arcuate bearing surface of the top member 42 is slidably engageable with the corresponding one arcuate bearing surface of the base member 40 for pivotable movement of the top member relative to the base member between the lowered and raised positions, such that the elevation adjusting axis $X_e$ is spaced a fixed distance from the base member 40 for all pivoting movement of the top member 42 relative to the base member between the lowered and raised positions. In the present embodiment, the distance between the base member 40 and the elevation adjusting axis $X_e$ is substantially equal to the radius of curvature of the base and top member bearing surfaces 46, 52 (e.g, about 0.7 inches).

Referring to FIGS. 5 and 6, the rear sight 20 further comprising a fastener 60 for adjustably locking the top member 42 to the base member 40. The fastener 60 comprises a threaded shaft 62 and a shoulder 64. The base member 40 comprises a threaded hole 66 for threadably receiving the threaded shaft 62 of the fastener. The top member 42 includes a through slot 68 sized for unrestricted passage therethrough of the threaded shaft 62. The fastener 60 is moveable between a released position and a locked position. The top member 42 is slidably moveable relative to the base member 40 between the lowered and raised positions when the fastener 60 is in the released position. The top member 42 is locked against movement relative to the base member 40 when the fastener 60 is in the locked position. The slot 68 in the top member 42 is sized to permit movement of the top member relative to both the fastener 60 and the base member 40 between the lowered and raised positions (FIG. 7) when the fastener is in the released position. The threaded shaft 62 of the fastener 60 is threaded into the threaded hole 66 (downward as shown in FIG. 6) sufficiently to cause the top member 42 to be pressed between the shoulder 64 of the fastener and the base member 40 when the fastener is in the locked position.

Figure 7:
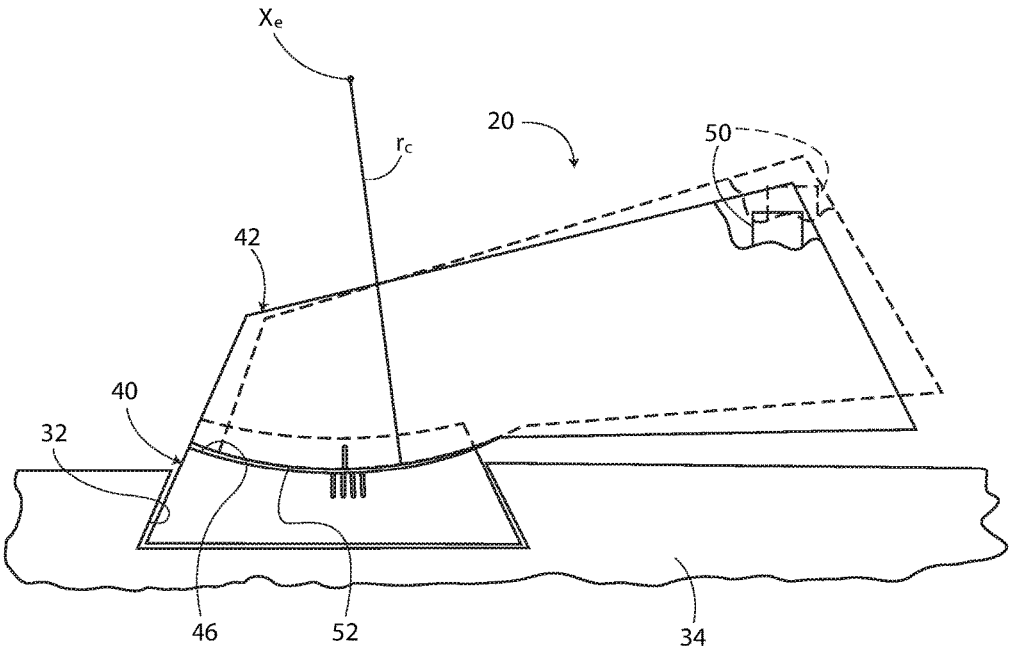
FIG. 7 is a fragmented side elevational view of the rear sight of FIGS. 1-6 with the base member received in a sight receiving slot in a slide of a firearm and showing movement of the top member relative to the base member between lowered and raised positions.

Referring to FIGS. 1, 6 and 7, the fitting portion 44 of the base member 40 is moveable relative to the sight receiving slot 32 for adjusting drifting of the rear sight 20. The rear sight further comprises at least one, and preferably two, set screws 70, each having a threaded shaft. The base member 40 comprises a pair of through set screw receiving holes 72. Each set screw receiving hole 72 having a thread for threadably receiving the threaded shaft of the corresponding set screw 70. Each set screw 70 is threadably moveable relative to the base member between a set screw released position and a set screw locked position. The set screws 70 and the base member are adapted for engagement of the set screw with the slide portion 34 of the firearm 22 (e.g., the set screw presses against the slide portion to wedge the fitting portion 44 upward in the sight receiving slot 32) to prevent movement of the base member 40 relative to the slide portion when the set screw is in the locked position. The top member 42 includes a pair of through access holes 74 (preferably in the form of slots) positioned to permit access to the set screws 70 via the access holes when the top member bearing surface 52 is in engagement with the base member bearing surface 46 and the fastener 60 is in the locked position. As shown in FIG. 6, the top member 42 and the base member 40 fit together in a manner that prevents the top member from moving laterally relative to the base member (i.e., moving either right or left as viewed in FIG. 6) even when the fastener 60 is in the released position. To adjust drifting, a user positions the set screws 70 in the set screw released position and moves the entire rear sight 20 laterally along the slot axis $X_s$. When the rear sight 20 is in the desired lateral position, the user tightens the set screws 70 to the set screw locked positions. Thus, drift may be adjusted without removing the top member 42 from the base member 40.

Figure 8:
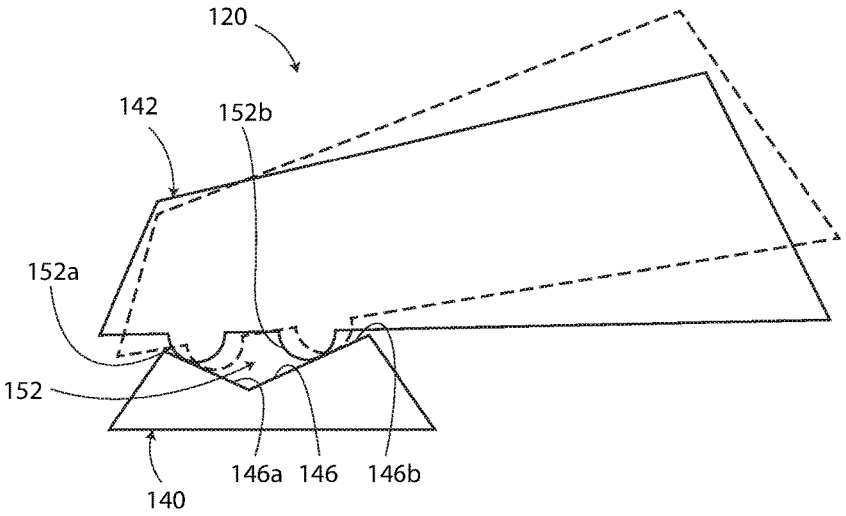
FIG. 8 is a schematic side elevational view of a second embodiment of a rear sight of the present invention.

Another embodiment of a rear sight of the present invention is generally indicated by reference numeral 120 in FIG. 8. The rear sight 120 is similar to the rear sight 20 of FIGS. 1-7 except for the differences noted herein. Thus, except for the noted differences, the above description of the rear sight 20 applies equally to the rear sight 120. The rear sight 120 comprises a base member 140 and a top member 142. The base member 140 is similar to the base member 40 described above except each base member bearing surface 146 of the base member 140 comprises first and second ramp portions 146*a* and 146*b* instead of an arcuate bearing surface. The first and second ramp portions 146*a*, 146*b* may be flat or curved, or one may be flat and the other curved. The top member 142 is similar to the top member 42 described above except each top member bearing surface 152 comprises spaced apart first and second top bearing surface portions 152*a* 152*b*. The base and top members 140, 142 are configured such that the first top bearing surface portion 152*a* slides along the first ramp portion 146*a* and the second top bearing surface portion 152*b* slides along the second ramp portion 146*b* as the top member 142 is moved relative to the base member 140 between the lowered position (shown in solid lines in FIG. 8) and the raised position (shown in dashed lines in FIG. 8).

Figure 9A:
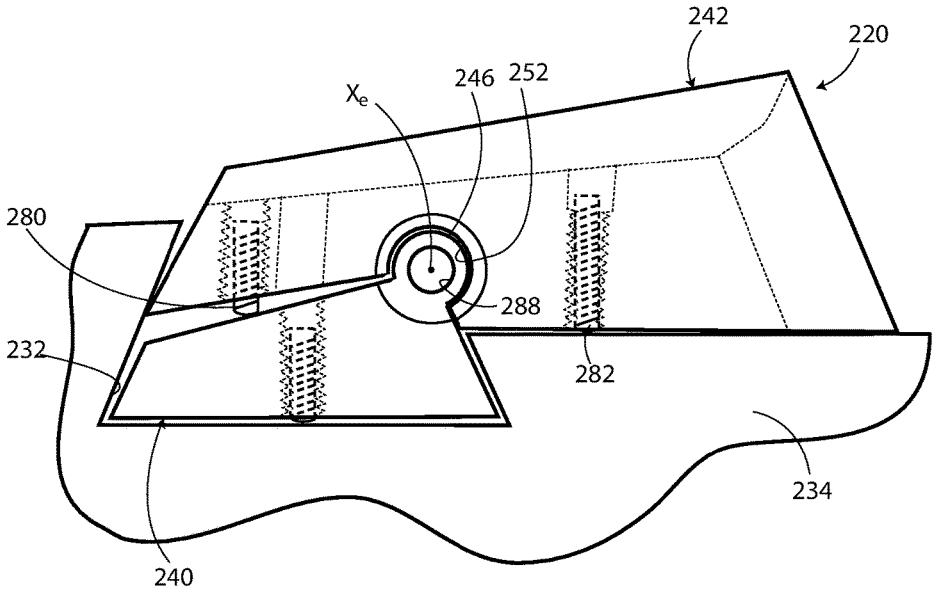
FIG. 9A is a side elevational view of a third embodiment of a rear sight of the present invention, the rear sight being in a lowered position.
Figure 9B:
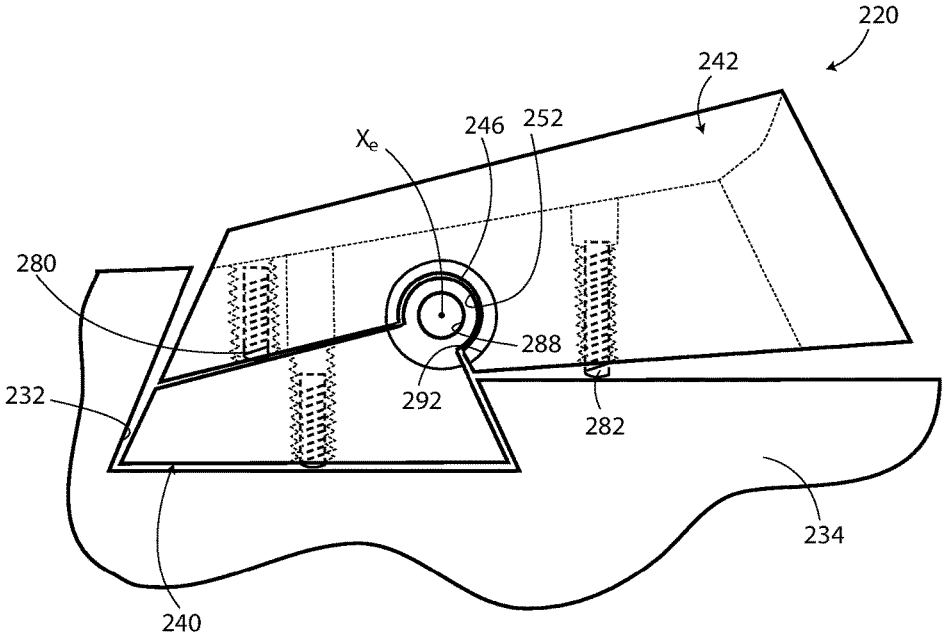
FIG. 9B is a side elevation view of the rear sight of FIG. 9A, except the rear sight is shown in a raised position.
Figure 10:
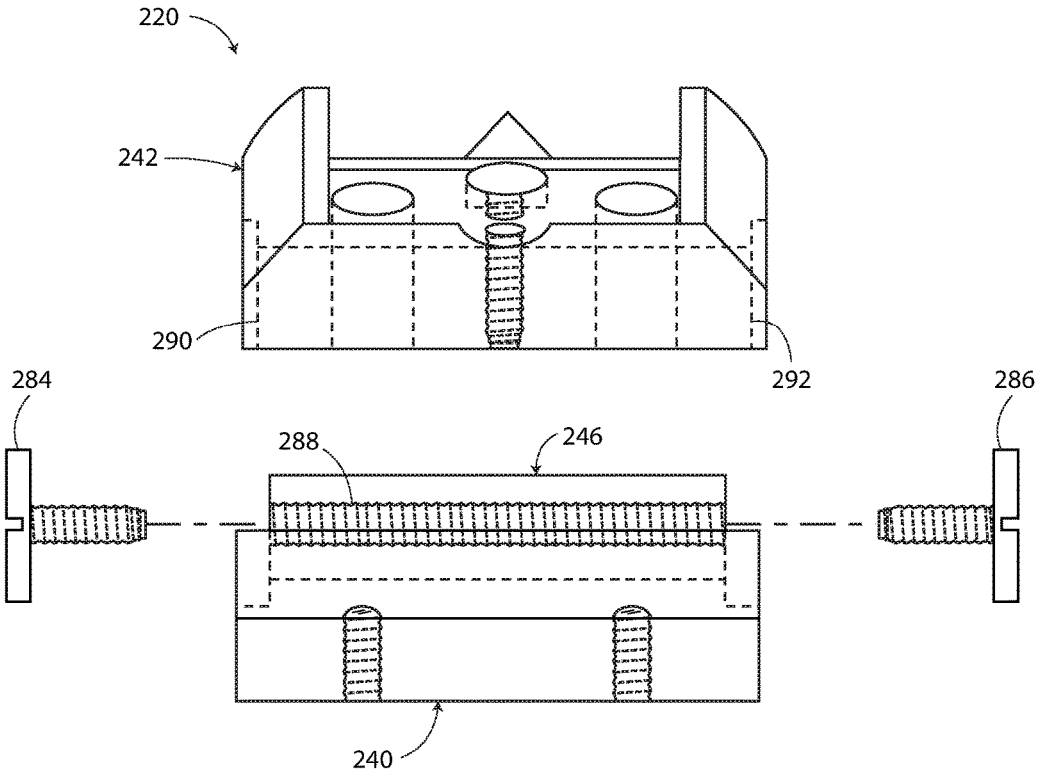
FIG. 10 is an exploded front elevational view of the rear sight of FIGS. 9A and 9B.

Another embodiment of a rear sight of the present invention is generally indicated by reference numeral 220 in FIGS. 9A, 9B and 10. The rear sight 220 is similar to the rear sight 20 of FIGS. 1-7 except for the differences noted herein. Thus, except for the noted differences or differences apparent from the drawing figures, the above description of the rear sight 20 applies equally to the rear sight 220. The rear sight 220 comprises a base member 240 and a top member 242. The base member 240 includes a base member bearing surface 246. The base member bearing surface 246 is convex and generally arcuate in shape. The top member 242 includes a top bearing surface 252. The top bearing surface is concave and generally arcuate in shape. The base and top members 240, 242 are configured such that the top bearing surface 252 slides on the base member bearing surface 246 as the top member 242 is moved relative to the base member 240 between the lowered position (shown in FIG. 9A) and the raised position (shown in FIG. 9B). The top member 242 pivots about the elevation adjusting axis Xe as the top member is moved between the lowered and raised positions. The top and base members 242, 240 are shaped and configured such that the top member 242 is placed onto or removed from the base member by sliding the top member onto the base member along the elevation adjusting axis Xe. As shown in FIGS. 9A and 9B, the rear sight 220 includes front and rear rotation limiting screws 280, 282. The front rotation limiting screw 280 is threaded into a front portion of the top member 242 and has a bottom end engageable with a surface of the base member 240. The front rotation limiting screw 280 adjustably limits rotation of the top member 242 relative to the base member 240 in a counterclockwise direction (as viewed in FIGS. 9A and 9B). The rear rotation limiting screw 282 is threaded into a rear portion of the top member 242 and has a bottom end engageable with a surface of the slide portion 234 of the firearm. The rear rotation limiting screw 282 adjustably limits rotation of the top member 242 relative to the base member 240 in a clockwise direction (as viewed in FIGS. 9A and 9B).

Referring to FIG. 10, the rear sight 220 also includes first and second windage adjustment screws 284, 286 for adjustably fixing the lateral position (positioning right or left as viewed in FIG. 10) of the top member 242 relative to the base member 240. The first windage adjustment screw 284 is adapted to be threaded into a threaded hole 288 in the one side of the base member 240 and the second windage adjustment screw 286 is adapted to be threaded into the threaded hole 288 on the other side of the base member. The heads of the windage adjustment screws 284, 286 are adapted to engage recessed shoulders 290, 292 in the top member 242 and engage the base member 240 only via the threaded holes. Thus, the relative lateral positions of the base and top members 240, 242 can be adjusted by loosening one of the windage adjustment screws and tightening the other.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent.

What is claimed is:

1. A rear sight for use in a firearm, the firearm including a barrel having a longitudinal barrel axis, a front sight having a front sight alignment portion, and a rear sight receiving portion, the rear sight receiving portion having a rear sight receiving slot rearwardly spaced from the front sight, the rear sight comprising:

a base member comprising a fitting portion and at least one base member bearing surface, the at least one base member bearing surface extending from a first lateral side of the base member to a second lateral side of the base member, the first lateral side of the base member being opposite the second lateral side of the base member, the fitting portion of the base member being shaped and configured to be inserted into and retained in the rear sight receiving slot of the firearm;

a top member comprising a rear sight alignment portion and at least one top member bearing surface, the rear sight alignment portion being adapted to be aligned with the front sight alignment portion of the firearm, the at least one top member bearing surface extending form a first lateral side of the top member to a second lateral side of the top member, the first lateral side of the top member being opposite the second lateral side of the top member;

the at least one top member bearing surface being slidably engageable with the at least one base member bearing surface for pivotable movement of the top member relative to the base member about a stationary laterally extending elevation adjusting axis between a lowered position and a raised position, the at least one top member bearing surface being slidably engageable with the at least one base member bearing surface for lateral movement of the top member relative to the base member along the stationary laterally extending elevation adjusting axis, the top member and the base member being adapted and configured such that the stationary laterally extending elevation adjusting axis is generally perpendicular to a plane containing the barrel axis, the base member and the top member being configured such that pivoting movement of the top member relative to the base member away from the lowered position and toward the raised position increases the distance between the rear sight alignment portion and the barrel axis of the firearm to thereby adjust the elevation of the rear sight alignment portion of the rear sight when the rear sight is attached to the firearm via the rear sight receiving slot, the base member being of a unitary, one-piece construction, the top member being of a unitary, one-piece construction; and a front rotation limiting screw and a rear rotation limiting screw, a front portion of the top member comprising a screw receiving-opening for receiving the front rotation limiting screw therethrough and a rear portion of the top member comprising a screw receiving-opening for receiving the rear rotation limiting screw therethrough, the front and the rear rotation limiting screws being adapted to adjustably limit movement of the top member relative to the base member.

2. The rear sight as set forth in claim 1 wherein the at least one top member bearing surface comprises at least one arcuate bearing surface having a radius of curvature, and wherein the at least one base member bearing surface comprises at least one arcuate bearing surface having a radius of curvature, the at least one arcuate bearing surface of the top member being slidably engageable with the at least one arcuate bearing surface of the base member for pivotable movement of the top member relative to the base member between the lowered and raised positions.

3. The rear sight as set forth in claim 2 wherein the at least one base member bearing surface is convex.

4. The rear sight as set forth in claim 2 wherein the at least one top member bearing surface is concave.

5. The rear sight as set forth in claim 1 further comprising a left windage adjustment screw and a right windage adjustment screw, each of the windage adjustment screws comprising a shaft, the left and right windage adjustment screws being adapted and configured to engage the base member and the top member, the left and right windage adjustment screws being adapted to adjustably fix the lateral position of the top member relative to the base member, the shaft of the left windage adjustment screw being adapted to extend along the laterally extending elevation adjusting axis when the left windage adjustment screw is in engagement with both the base member and the top member, the shaft of the right windage adjustment screw being adapted to extend along the laterally extending elevation adjusting axis when the right windage adjustment screw is in engagement with both the base member and the top member.

* * * * *